US010542807B2

(12) United States Patent
Gonzalez et al.

(10) Patent No.: US 10,542,807 B2
(45) Date of Patent: Jan. 28, 2020

(54) MULTI-FUNCTION ACTUATOR FOR ADJUSTING TWO OR MORE HAIR APPLIANCE VARIABLES

(71) Applicant: Helen of Troy Limited, St. Michael (BB)

(72) Inventors: Arturo Adrian Gonzalez, El Paso, TX (US); Gary Koenemann, El Paso, TX (US)

(73) Assignee: Helen Of Troy Limited, St. Michael (BB)

( * ) Notice: Subject to any disclaimer, the term of this patent is extended or adjusted under 35 U.S.C. 154(b) by 365 days.

(21) Appl. No.: 15/379,603

(22) Filed: Dec. 15, 2016

(65) Prior Publication Data

US 2018/0000216 A1 Jan. 4, 2018

Related U.S. Application Data

(60) Provisional application No. 62/356,586, filed on Jun. 30, 2016.

(51) Int. Cl.
*A45D 4/00* (2006.01)
*A45D 1/28* (2006.01)
(Continued)

(52) U.S. Cl.
CPC ..... *A45D 1/28* (2013.01); *A45D 1/04* (2013.01); *A45D 2/001* (2013.01); *A45D 20/12* (2013.01)

(58) Field of Classification Search
CPC ... A45D 1/02; A45D 1/04; A45D 1/16; A45D 1/28; A45D 6/00; A45D 6/02;
(Continued)

(56) References Cited

U.S. PATENT DOCUMENTS 1,809,458 A 6/1931 Wahl
4,968,870 A * 11/1990 Moon ..... A45D 1/28 219/222

(Continued)

FOREIGN PATENT DOCUMENTS

EP 1616500 1/2006

OTHER PUBLICATIONS

Search Report and Written Opinion. PCT/US2017/033516, dated Aug. 14, 2017, 10 pgs.

*Primary Examiner* — Nicholas D Lucchesi
(74) *Attorney, Agent, or Firm* — Egan Peterman Enders Huston

(57) ABSTRACT

Exemplary embodiments of hair styling appliances having a multi-function actuator are provided herein. In general, the disclosed embodiments of hair styling appliances may include a multi-function actuator configured for adjusting settings of one or more hair appliance variables. In one embodiment, the multi-function actuator may include at least two separate actuators, which are assembled together on the hair styling appliance to look like one component, yet are configured to be actuated independently of one another. In one embodiment, the multi-function actuator may be ergonomically positioned on the hair styling appliance for easily accessible manipulation and actuation with the user's thumb. In one embodiment, the multi-function actuator may comprise a push button and dial combination. In one embodiment, the push button may be used to select temperature and/or time, and the dial may be used to adjust the temperature and/or time to a desired setting.

23 Claims, 7 Drawing Sheets

(51) Int. Cl.
*A45D 1/04* (2006.01)
*A45D 2/00* (2006.01)
*A45D 20/12* (2006.01)

(58) Field of Classification Search
CPC .. A45D 2/001; A45D 20/12; A45D 2001/008; A45D 2200/202
See application file for complete search history.

(56) References Cited

U.S. PATENT DOCUMENTS 5,119,847 A 6/1992 Powell et al.
5,951,894 A * 9/1999 White, Jr. ..... A45D 20/48 219/222
7,429,458 B2 9/2008 Chilkoti
7,620,431 B2 11/2009 Hawkins et al.
8,080,764 B2 12/2011 Shami et al.
8,237,686 B2 8/2012 Yoneji
8,938,888 B1 1/2015 Brown
D727,568 S 4/2015 Francois
D736,998 S 8/2015 Koehler et al.
9,237,787 B2 1/2016 Lam et al.
D767,205 S 9/2016 Climer et al.
2005/0011533 A1* 1/2005 Ruben ..... A45D 1/04 132/230
2005/0051188 A1 3/2005 Leung
2005/0198855 A1* 9/2005 Cafaro ..... A45D 20/10 34/97
2006/0191888 A1* 8/2006 Carlucci ..... A45D 1/04 219/225
2006/0201527 A1 9/2006 Higgins et al.
2007/0175881 A1 8/2007 Yeung
2010/0089413 A1 4/2010 Wright et al.
2010/0224206 A1 9/2010 Serresvives et al.
2012/0111354 A1 5/2012 Cafaro et al.
2012/0111357 A1* 5/2012 Amkie ..... A45D 1/04 132/230
2013/0025620 A1* 1/2013 Keong ..... A45D 1/04 132/227
2013/0306099 A1 11/2013 Lam et al.
2014/0216493 A1 8/2014 Hadden
2014/0366909 A1 12/2014 Richmond et al.

* cited by examiner

MULTI-FUNCTION ACTUATOR FOR ADJUSTING TWO OR MORE HAIR APPLIANCE VARIABLES

This application claims priority to Provisional Patent Application No. 62/356,586 filed Jun. 30, 2016; the disclosure of which is expressly incorporated herein by reference.

TECHNICAL FIELD OF THE INVENTION

The techniques disclosed herein relate to heated hair styling appliances, and more specifically, to hair styling appliances having a multi-function actuator for adjusting a setting of one or more hair appliance variables.

BACKGROUND

The following descriptions and examples are provided as background only and are intended to reveal information that is believed to be of possible relevance to the present disclosure. No admission is necessarily intended, or should be construed, that any of the following information constitutes prior art impacting the patentable character of the subject matter claimed herein.

A wide variety of hair appliances may be utilized to style hair, including but not limited to, hair dryers, curling irons and flat irons. Many of such devices enable the user to select and set one or more hair appliance variables, such as a desired temperature, time, fan speed, moisture level, ion injection, etc. However, these devices typically require one or more separate buttons, dials or other actuators for setting each hair appliance variable. For example, a hair dryer may include three separate actuators (e.g., buttons, switches, dials, etc.) for individually selecting a desired temperature setting, a desired fan speed and a desired moisture level for styling a user's hair. In another example, a curling iron or flat iron may include multiple buttons for turning a heat source on/off and setting a desired temperature. Devices that require manipulation of multiple actuators to select various settings are difficult to use, especially during the act of styling one's hair.

SUMMARY

The following description of various embodiments of hair styling appliances and methods is not to be construed in any way as limiting the subject matter of the appended claims.

The hair styling appliance disclosed herein advantageously provides a unique multi-function actuator for adjusting a setting of one or more hair appliance variables. The hair appliance variables available for adjustment with the multi-function actuator are generally dependent on the hair styling appliance in which the actuator is used. Examples of hair appliance variables that may be adjusted with the multi-function actuator described herein include, but are certainly not limited to, temperature, time, multi-zone temperature settings, fan speed, moisture level/steam, barrel rotation, ion injection, etc. Advantages of the multi-function actuator described herein include, but are not limited to, fewer buttons/actuators and greater ease of use. Other advantages will be apparent to a skilled artisan upon reading this disclosure.

According to one embodiment, a hair styling appliance is provided with a multi-function actuator configured for adjusting a setting of one or more hair appliance variables. In one embodiment, the multi-function actuator may include at least two actuators (e.g., a first actuator and a second actuator), which are arranged adjacent to one another on the hair styling appliance and configured to be actuated independently of one another. In one embodiment, the first and second actuators may include a button and a dial, which is shaped and dimensioned to surround at least a portion of an outer circumference of the button. As used herein, "at least a portion" may include some percentage of the outer circumference ranging between about 10% to about 100% of the outer circumference.

The hair styling appliance may also include a control circuit, which is coupled to the multi-function actuator and configured for controlling operation of the hair styling appliance in response to actuation of at least one of the first and the second actuators. The control circuit may control the operation of the hair styling appliance differently for different embodiments of the multi-function actuator.

In a first embodiment, the multi-function actuator may be used to select and/or adjust substantially any number of hair appliance variables (e.g., any number of the following: temperature, time, multi-zone temperature settings, fan speed, moisture level/steam, barrel rotation, ion injection, etc.). Upon actuation of the first actuator, the control circuit may be configured to toggle through and/or select a hair appliance variable from a plurality of hair appliance variables, which are available for user selection and adjustment. Upon actuation of the second actuator, the control circuit may be configured to adjust a setting of the selected hair appliance variable, and to subsequently control the operation of the hair styling appliance in accordance with the adjusted setting.

In one exemplary implementation of the first embodiment, the first actuator may also be used to activate a timer. In such an implementation, the control circuit may be configured to toggle through and/or select a hair appliance variable from the plurality of hair appliance variables upon actuation of the first actuator for a first length of time, and may be configured to activate a timer upon actuation of the first actuator for a second length of time. The first length of time may be longer than the second length of time (or vice versa) to assist the control circuit in differentiating between the timer functionality from the hair appliance variable selection functionality. Upon reaching an end point of the timer, the control circuit may be further configured to activate a user notification of time-out to indicate that a selected time duration has been reached.

In a second embodiment, the multi-function actuator may be used to adjust only two hair appliance variables (e.g., temperature and time, fan speed and temperature, etc.). In such an embodiment, the control circuit may be configured to adjust a setting of a first hair appliance variable in response to user-actuation of the first actuator, adjust a setting of a second hair appliance variable in response to user-actuation of the second actuator, and control the operation of the hair styling appliance in accordance with the adjusted settings.

In one exemplary implementation of the second embodiment, the first hair appliance variable may be a time variable and the second hair appliance variable may be a different hair appliance variable, such as but not limited to, temperature, fan speed, moisture level, ion injection, or barrel rotation speed. In such an example, the control circuit may be configured to adjust the time variable to a user-selected time duration in response to user-actuation of the first actuator for a first length of time, and may activate a timer in response to user-actuation of the first actuator for a second length of time. The first length of time may be shorter than the second length of time (or vice versa) to assist the control circuit in differentiating between the timer functionality and the time selection functionality. If the timer is activated, the control circuit may be further configured to activate a user notification of time-out to indicate when the user-selected time duration has been reached.

In a third embodiment, the multi-function actuator may be used to adjust only one hair appliance variable (e.g., time). In such an embodiment, the control circuit may be configured to adjust a setting of a time variable to a user-selected time duration in response to user-actuation of the first actuator, and activate a timer in response to user-actuation of the second actuator. If the timer is activated, the control circuit may be further configured to activate a user notification of time-out to indicate when the user-selected time duration has been reached.

According to another embodiment, a hair styling appliance is provided herein with a multi-function actuator and a handle. The multi-function actuator may generally include a first actuator and a second actuator, which are arranged adjacent to one another on the hair styling appliance and configured to be actuated independently of one another. The handle preferably enables a user to grip a lower portion of the handle with the user's palm and fingers without actuating the multi-function actuator with the user's palm or fingers.

In one embodiment, the multi-function actuator may be ergonomically positioned on the hair styling appliance for easily accessible manipulation and actuation with the user's thumb. For example, the multi-function actuator may be positioned near an upper portion of the handle at a location, which enables the user to manipulate the multi-function actuator with the user's thumb. In one embodiment, the ergonomic position of the multi-function actuator on the hair styling appliance may enable the user to activate and reactivate the first actuator with the user's thumb without the user having to look at the first actuator.

In one embodiment, the hair styling appliance is a curling iron comprising an elongated barrel extending out from the upper portion of the handle. In such an embodiment, the multi-function actuator may be positioned near a juncture between the elongated barrel and the upper portion of the handle. In one embodiment, the upper portion of the curling iron handle may be bent at an angle of approximately 90° to the lower portion of the handle, and the elongated barrel may extend out from the upper portion along a longitudinal axis of the upper portion. In such an embodiment, the multi-function actuator may be positioned at or near an outside corner formed between the upper portion and lower portion of the handle, for example.

In one embodiment, the hair styling apparatus may comprise no other buttons, dials or actuators for adjusting hair appliance variables (other than the multi-function actuator). In one embodiment, the multi-function actuator may be the only actuator included on the hair styling appliance. In another embodiment, the hair styling appliance may comprise a power button for turning the hair styling appliance on/off.

According to another embodiment, user-implemented methods for utilizing a multi-function actuator to adjust one or more hair appliance settings are provided. According to yet another embodiment, a method of controlling a hair styling appliance in accordance with one or more adjustable hair appliance settings is provided.

DESCRIPTION OF THE DRAWINGS

Other objects and advantages of the disclosure will become apparent upon reading the following detailed description and upon reference to the accompanying drawings.

Figure 1:
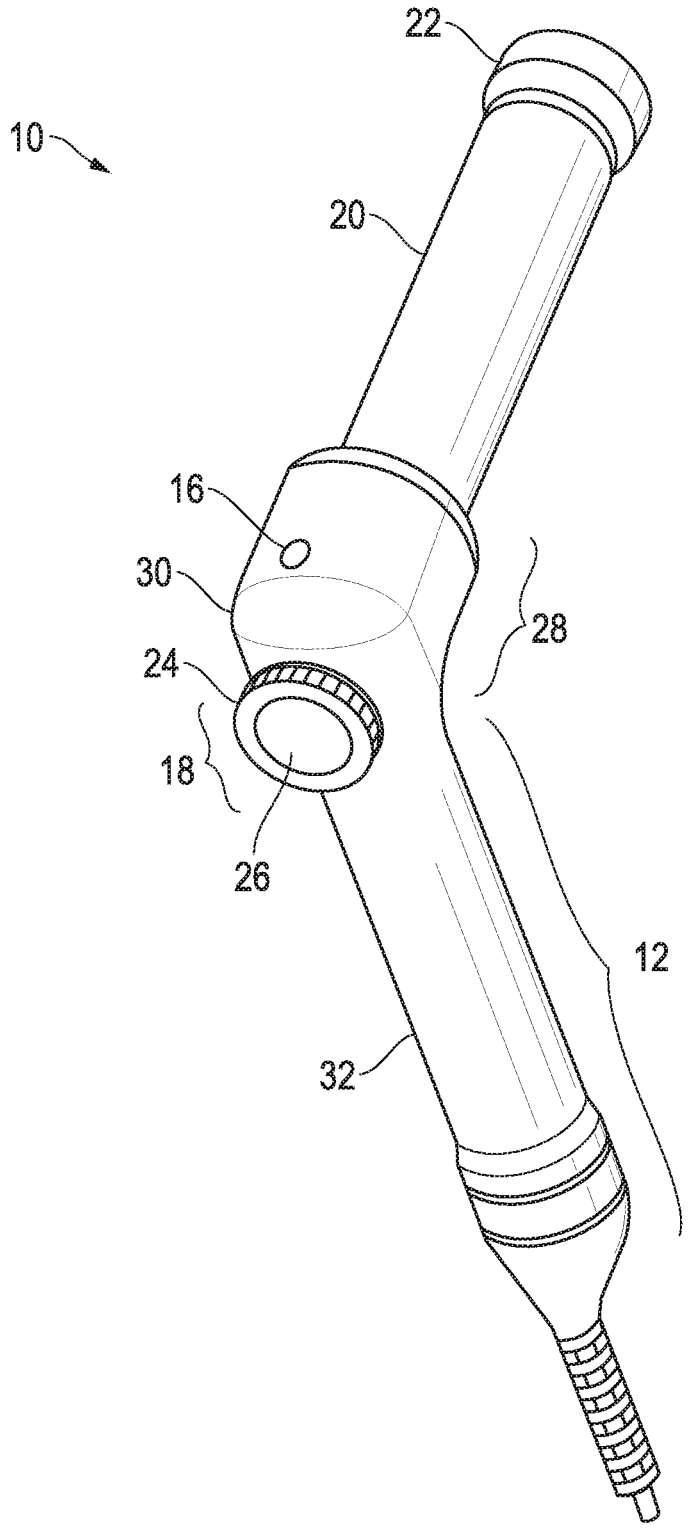
FIG. 1 is a perspective view illustrating one embodiment of an exemplary hair styling appliance comprising a multi-function actuator for adjusting a setting of one or more hair appliance variables.

While the embodiments of hair styling appliances and methods disclosed herein are susceptible to various modifications and alternative forms, specific embodiments thereof are shown by way of example in the drawings and will herein be described in detail. It should be understood, however, that the drawings and detailed description thereto are not intended to limit the disclosure to the particular form disclosed, but on the contrary, the disclosure is intended to cover all modifications, equivalents and alternatives falling within the spirit and scope of the present disclosure as defined by the appended claims.

DETAILED DESCRIPTION OF PREFERRED EMBODIMENTS

In general, the present disclosure is directed to embodiments of hair styling appliances having a multi-function actuator, which may be easily manipulated by a user for adjusting a setting of at least one hair appliance variable. In preferred embodiments, the multi-function actuator described herein may be manipulated by a user for selecting a hair appliance variable from a plurality of hair appliance variables, which are available for user selection and adjustment, and for adjusting a setting of a selected one of the hair appliance variables. As used herein, a "hair appliance variable" may be described as an operational parameter of a hair styling appliance, and a "setting" may be described as a value or set point associated with a particular hair appliance variable.

The multi-function actuator described herein is not limited to any particular type of hair styling appliance, any particular number or combination of hair appliance variables, or any particular number of settings. However, the type of hair styling appliance may dictate, to some extent, the hair appliance variables and settings, which are available for user selection and adjustment via the multi-function actuator. When included on a hair dryer, for example, the multi-function actuator may enable a user to adjust temperature and/or fan speed settings. In some embodiments, the multi-function actuator may also enable a user to adjust a moisture level setting and/or an ion injection setting of the hair dryer. On the other hand, a multi-function actuator may enable a user to adjust temperature and/or time settings when included on a curling iron or a flat iron. If a curling iron is configured with a rotating barrel, embodiments of the multi-function actuator described herein may additionally enable a user to adjust the barrel rotation speed.

Figure 2:
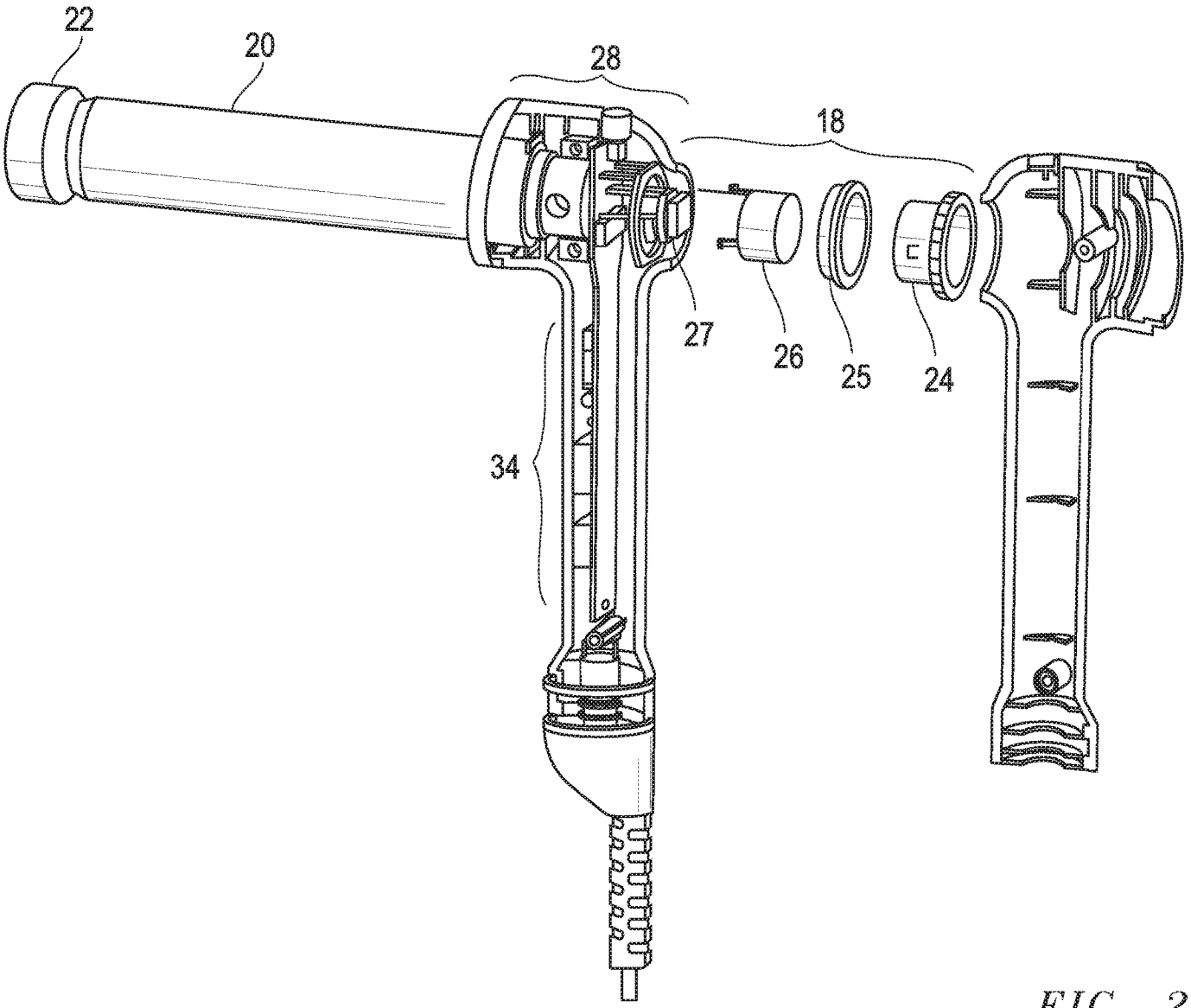
FIG. 2 is an exploded, side view of the exemplary hair styling appliance shown in FIG. 1.
Figure 3:
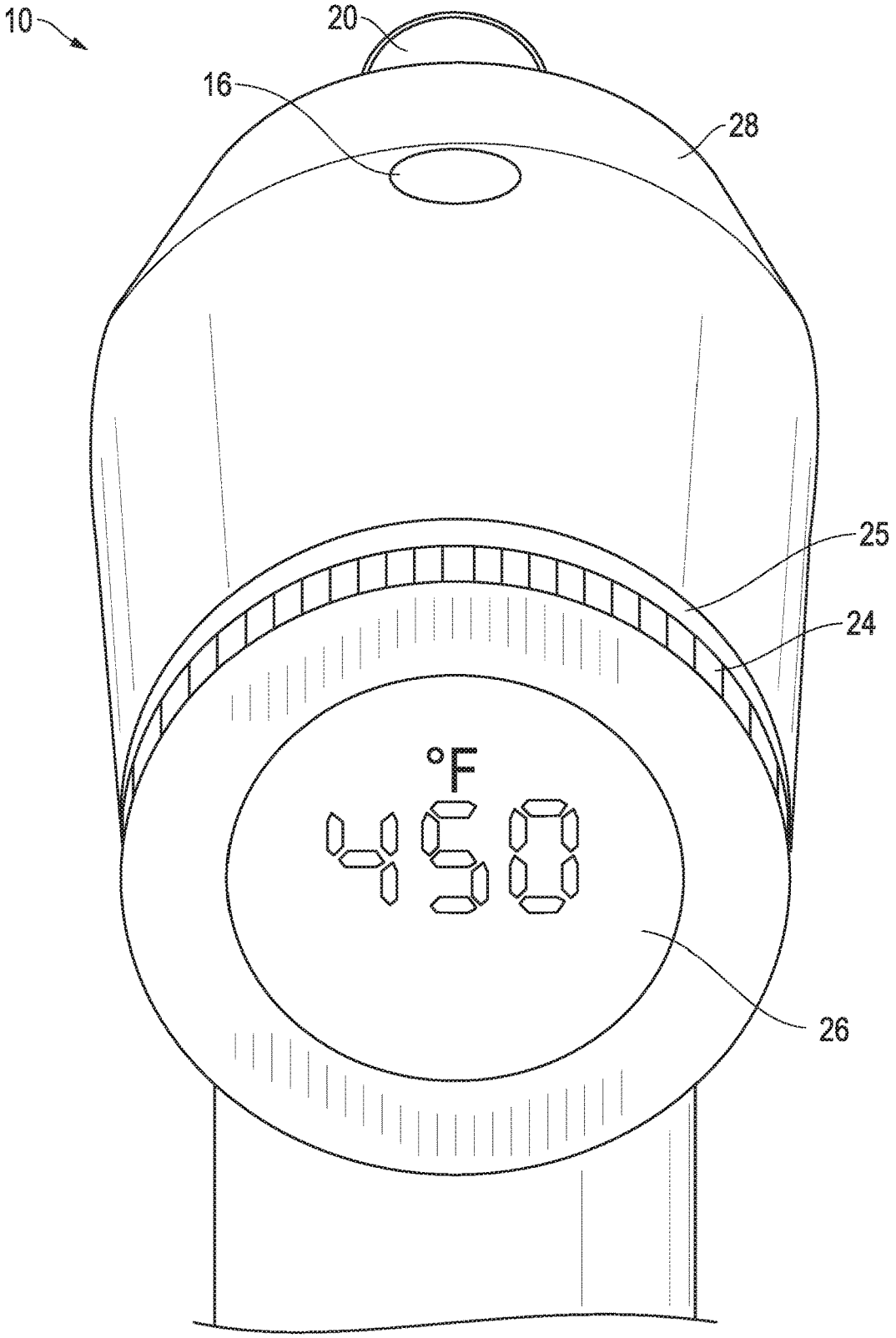
FIG. 3 is an end view of the exemplary hair styling appliance, according to another embodiment.
Figure 4A:
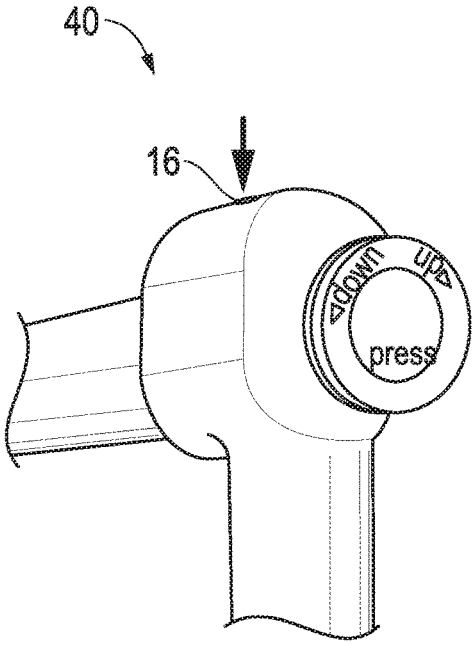
FIGS. 4A-4D is a progression of images depicting a user-implemented method for utilizing a multi-function actuator to adjust a temperature setting of the exemplary hair styling appliance.
Figure 4B:
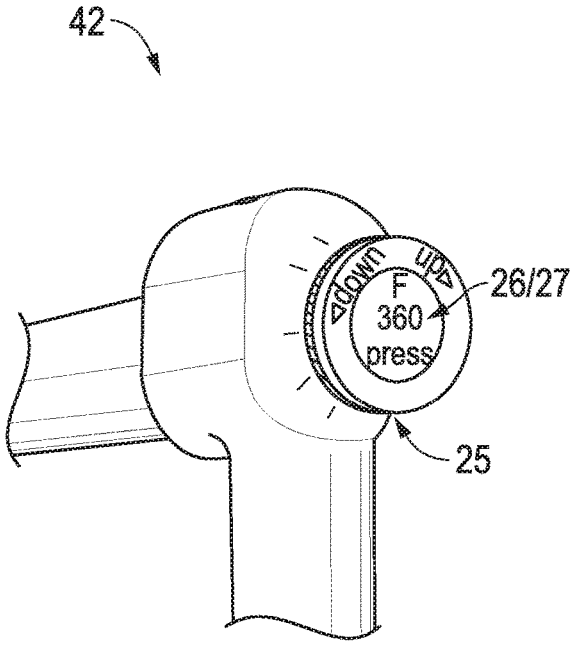
Figure 4C:
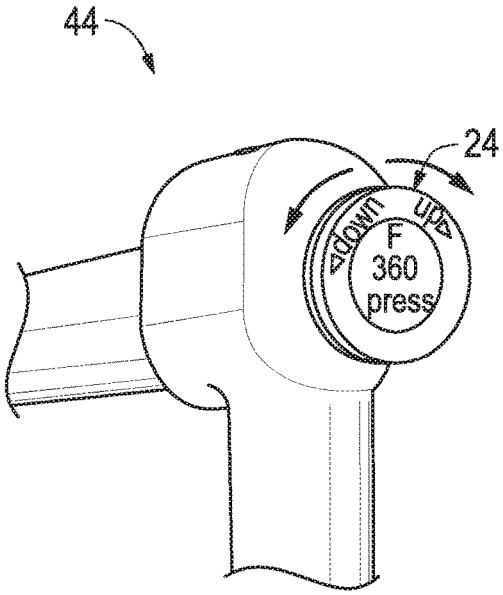
Figure 4D:
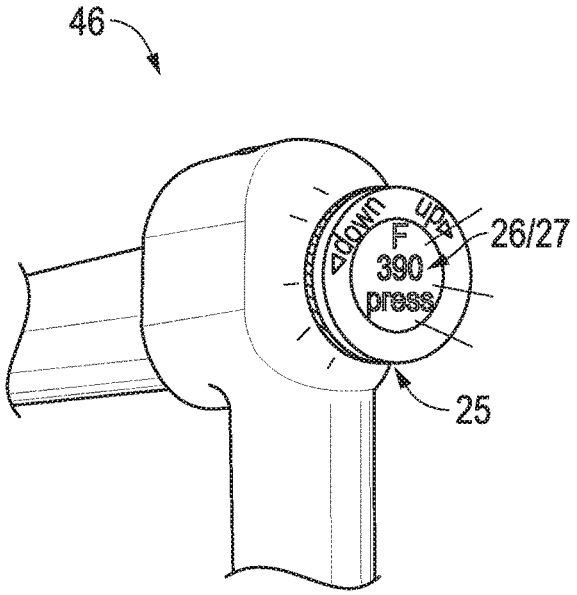
Figure 5A:
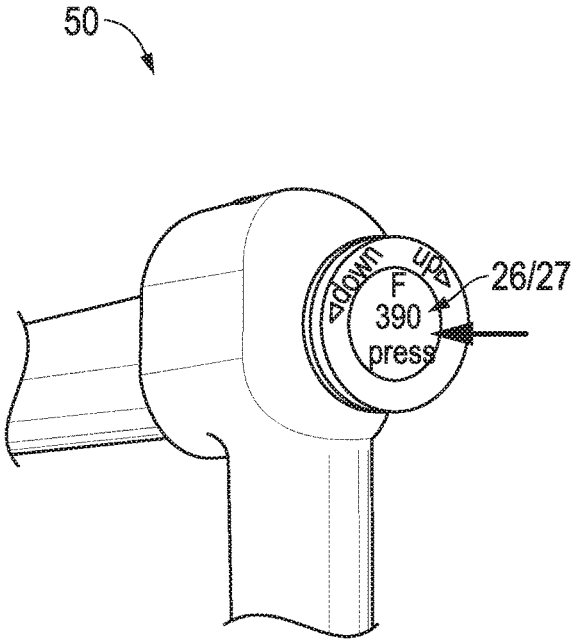
FIGS. 5A-5F is a progression of images depicting a user-implemented method for utilizing a multi-function actuator to adjust and use a time setting of the exemplary hair styling appliance.
Figure 5B:
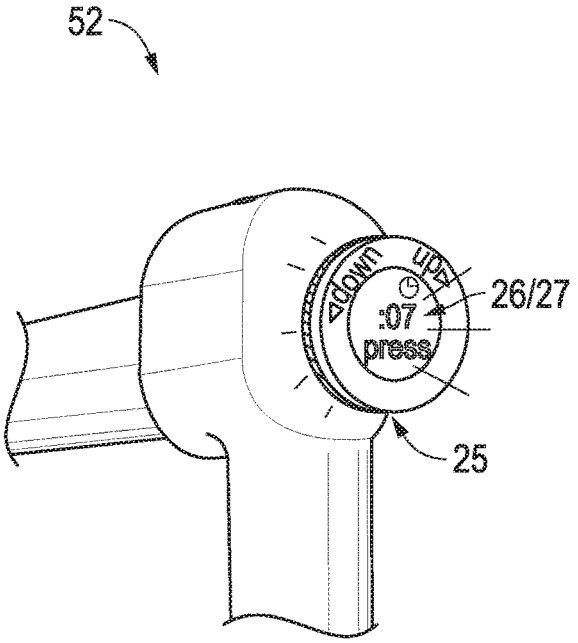
Figure 5C:
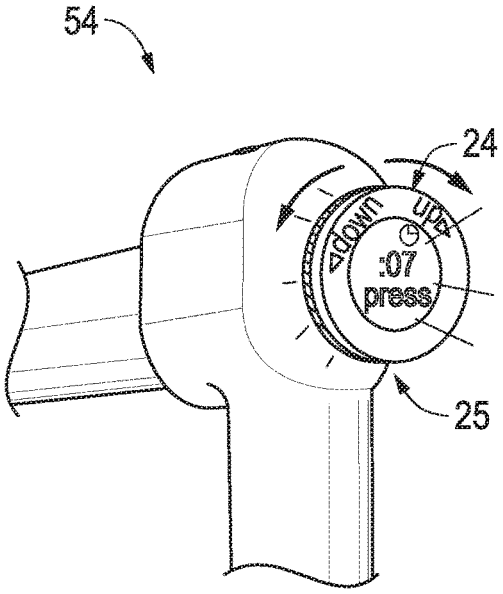
Figure 5D:
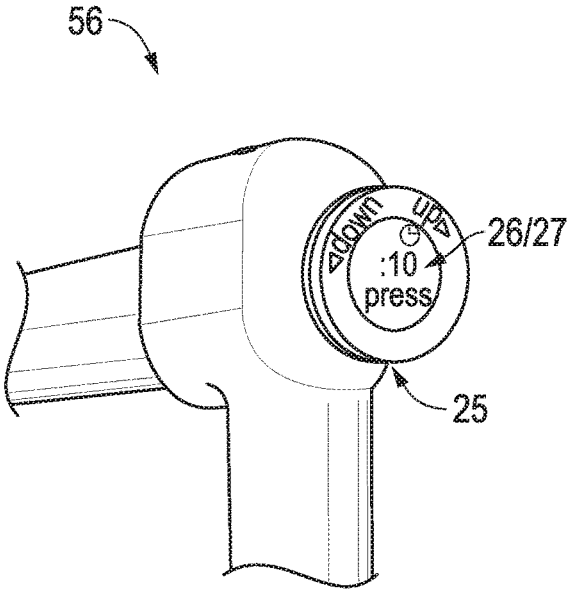
Figure 5E:
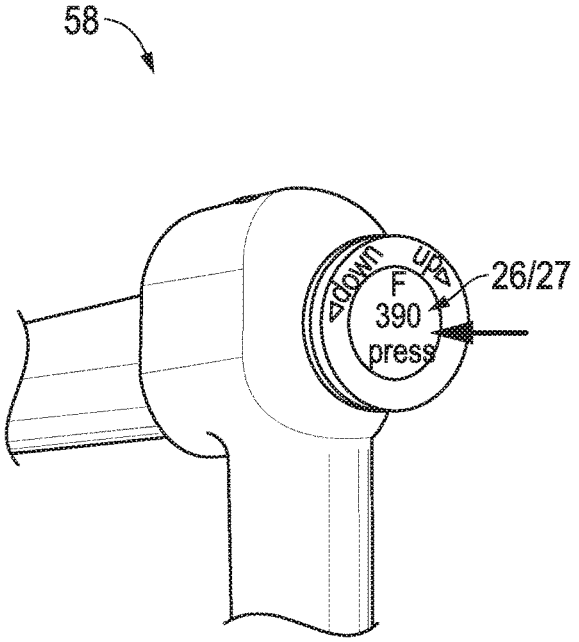
Figure 5F:
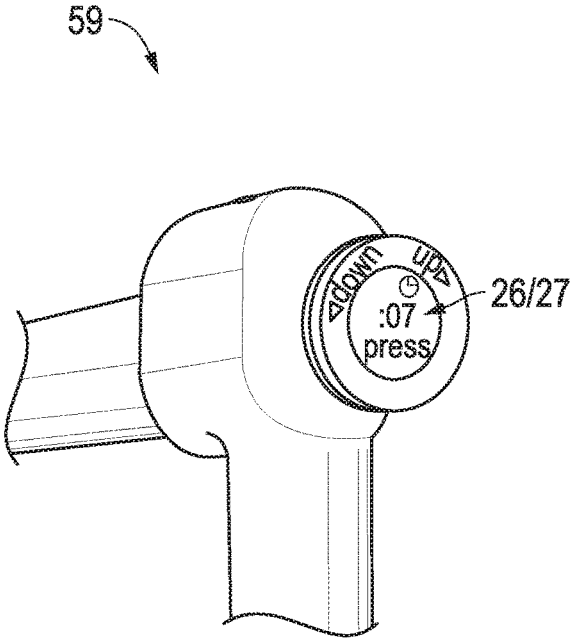

An exemplary hair styling appliance having a multi-function actuator for adjusting settings of one or more hair appliance variables is shown in FIGS. 1-3 as hair styling appliance 10. The hair styling appliance depicted in the figures is an exemplary curling iron with a 90° handle, however, it will be recognized that the multi-function actuator and associated techniques described herein may be utilized with other types of curling irons and other types of hair styling appliances, such as hair straighteners, flat irons, hair crimpers, hair dryers, etc. Although described herein primarily with respect to the adjustment of temperature and time, it will be further recognized that the multi-function actuator described herein may be provided and used for adjusting settings of other hair appliance variables (e.g., fan speed, barrel rotation speed, moisture level, ion injection amount, etc.) for potentially other types of hair styling appliances.

As shown in FIGS. 1-3, an exemplary hair styling appliance 10 may generally include a handle 12, an electrical supply cord 14, an on/off switch (or power button) 16, a multi-function actuator 18 and a styling element 20. In the exemplary embodiment shown, hair styling appliance 10 is a curling iron, and as such, the styling element 20 is an elongated barrel 20, which is configured to be heated by an internal heating element (not shown). The elongated barrel 20 may be formed from a variety of heat conducting materials (e.g., metals, ceramics, etc.), and may or may not terminate in an end cap 22, which is generally not heated and used as a user grip location. When heated by the internal heating element, the elongated barrel 20 may be used for applying heat to a section of the user's hair, which is wound around elongated barrel 20, to create a curl or wave in the heated section of hair. In some embodiments, the elongated barrel 20 may be a rotating barrel, which may rotate at a default or user-selectable barrel rotation speed.

Internal heating element(s) may be located within the styling element 20 as is well known in the art. For example, the internal heating element included within the hair styling appliance 10 of FIGS. 1-3 may be an electric heating element. A wide range of heating elements may be utilized all as would be known in the art. In some embodiments, hair styling appliance 10 may include a single internal heating element that spans the length of styling element 20. Alternatively, the styling element 20 may comprise a plurality of heating zones, each configurable with a different temperature, and separate heating elements may be provided for each heating zone.

In other embodiments of hair styling appliances (not shown), other types of styling elements for applying heat to a user's hair (i.e., other than the elongated barrel 20 shown in FIGS. 1-3) may be provided. For example, a hair dryer may include a heater, fan, fan motor and air funnel for generating and directing heated and/or conditioned air to the user's hair. In another example, a hair straightener (or "flat iron") may include one or more planar surfaces configured for applying heat to a section of the user's hair to straighten the heated section of hair. Although depicted for use within a curling iron, the multi-function actuator described herein may be provided and used for controlling a wide range of hair styling appliances and styling elements. Thus, the multi-function actuator described herein may be utilized independent of any particular type of hair styling appliance or styling element. Moreover, as described the multi-function actuator may be used independent of any particular type of hair styling appliance variables that are controlled.

One embodiment of a multi-function actuator 18 is shown in FIGS. 1-3. Generally speaking, multi-function actuator 18 may be located substantially anywhere on the hair styling appliance 10, other than on the elongated barrel 20 (or other styling element provided in other embodiments of hair styling apparatuses). In some embodiments, the multi-function actuator 18 may be located at or near a juncture between handle 12 and elongated barrel 20. In other embodiments, the multi-function actuator 18 may be arranged elsewhere along handle 12, or alternatively, within the end cap 22. As described in more detail below, however, the multi-function actuator 18 is preferably arranged near an upper portion of the handle 12 at a location, which enables a user to easily manipulate the multi-function actuator 18 with the user's thumb.

In the illustrated embodiment, hair styling appliance 10 is a curling iron having a substantially right angle handle. In this type of curling iron, an upper portion 28 of handle 12 is bent at an angle of approximately 90° (e.g., about 85° to about 95°) to a lower portion 32 of the handle 12, and the elongated barrel 20 extends out from the upper portion 28 along a longitudinal axis of the upper portion. In one embodiment, the multi-function actuator 18 may be positioned at or near an outside corner 30 formed between the upper portion 28 and lower portion 32 of the handle 12. Alternatively, the multi-function actuator 18 may be positioned on a top surface or a side surface of the upper portion 28 in other embodiments.

Several advantages are realized by positioning the multi-function actuator 18, as shown in FIGS. 1-3. For instance, the position depicted in FIGS. 1-3 provides sufficient surface area for a user to grip the lower portion 32 of the handle 12 with the user's palm and fingers without accidentally actuating the multi-function actuator 18 with the palm or fingers. When gripping the lower portion 32 with the palm and fingers, the multi-function actuator 18 shown in FIGS. 1-3 is also ergonomically positioned for easily accessible manipulation and actuation with the user's thumb. This may make it easier for a user to select one or more hair appliance variables, adjust a setting of one or more hair appliance variables, and/or control the hair styling appliance in accordance with one or more hair appliance settings, while using the hair styling appliance. In some cases, the ergonomic positioning of the multi-function actuator 18 may enable the user to easily set, adjust and/or use one or more hair appliance settings during the act of styling one's hair.

The multi-function actuator described herein, or some variant thereof, may provide the same or similar advantages when incorporated on other types of hair styling appliances. For example, a multi-function actuator may be positioned on a handle of a hair dryer, wherein such positioning enables a user to grip the handle without accidentally actuating the multi-function actuator with the palm or fingers, while enabling the user to easily manipulate the multi-function actuator with the user's thumb. Regardless of the particular type of hair styling appliance, the multi-function actuator may be ergonomically positioned for right-hand operation, left-hand operation, or both right- and left-hand operation of the hair styling appliance.

In general, the multi-function actuator 18 may be configured for adjusting a setting of one or more hair appliance variables. As noted above, the hair appliance variables available for adjustment via the multi-function actuator may generally depend on the particular type of hair styling appliance comprising the multi-function actuator. In one embodiment, the multi-function actuator 18 depicted in FIGS. 1-3 may be used to select, adjust and/or use various temperature and time settings for controlling the operation of the curling iron 10 depicted in FIGS. 1-3. In some embodiments, the multi-function actuator 18 depicted in FIGS. 1-3 may also be used to select, adjust and/or use other hair appliance variables (e.g., barrel rotation speed, multi-zone temperature settings, moisture level/steam, and/or ion injection, etc.) for controlling the operation of the depicted curling iron 10. When incorporated within other types of hair styling appliances (e.g., flat irons, hair dryers, etc.), the multi-function actuator 18 may be used to select, adjust and/or use other hair appliance variables (e.g., fan speed, temperature, time, moisture level/steam and/or ion injection, etc.) specifically pertaining to that hair styling appliance.

In one embodiment, the multi-function actuator 18 may be the only actuator included on the hair styling appliance 10. In such an embodiment, the multi-function actuator 18 may further be used to turn on/off the power supplied to the hair styling appliance. Alternatively, hair styling appliance 10 may include a power button (e.g., power button 16) for turning the power on/off. In one embodiment, the multi-function actuator 18 and the power button 16 may be the only actuators included on hair styling appliance 10. In another embodiment, one or more additional actuators may be included on the hair styling appliance for controlling the operation or changing the configuration of the hair styling appliance.

In some embodiments, the multi-function actuator described herein may include at least two actuators (e.g., a first actuator and a second actuator), which are arranged adjacent to one another on the hair styling appliance and configured to be actuated independently of one another. The first and second actuators are preferably assembled together on the hair styling appliance, such that one of the actuators at surrounds at least a portion of an outer circumference of the other actuator. In some embodiments, one of the actuators may completely surround the other actuator (i.e., one actuator may surround 100% of the outer circumference of the other actuator). In other embodiments, one actuator may not completely surround the other actuator (e.g., one actuator may surround only 25%, 50% or 75% of the outer circumference of the other actuator). As used herein, surrounding "at least a portion" means that one actuator is dimensioned and shaped to surround some percentage of the outer circumference of the other actuator, where such percentage ranges between about 10% and about 100%.

In the illustrated embodiment, multi-function actuator 18 comprises dial 24 and push button 26. In order to be perceived as one component, dial 24 may be shaped and dimensioned so as to closely surround push button 26. According to one embodiment, push button 26 may have a circular outer circumference, and dial 24 may have a ring-shape configured to receive and closely surround the circular outer circumference of push button 26, as shown in FIGS. 1-3. In order for dial 24 to "closely surround" push button 26, push button 26 may be shaped and dimensioned so that the outer circumference of the push button just fits within an inner diameter of the ring-shaped dial with some tolerance that enables push button 26 and dial 24 to be actuated independently of one another. In this manner, dial 24 and push button 26 may appear to be a single component on the hair styling appliance 10, yet may be actuated independently of one another.

Although depicted as such, the multi-function actuator described herein is not limited to a dial and push button combination, and may include other types and combinations of actuators (e.g., including, but not limited to, dials, push buttons, linear switches, rocker switches, etc.) in other embodiments. Although a dial and push button combination represents one preferred embodiment of multi-function actuator 18, it is noted that the dial and push button are not strictly limited to the particular shapes, dimensions, configurations or placements shown in the figures. While it is generally preferred that dial 24 have a substantially circular inner circumference, so as to enable free rotation of dial 24 around push button 26, the outer circumference of dial 24 may not be strictly circular in all embodiments. In one example, the outer circumference of dial 24 may comprise small ridges, as shown in FIGS. 1-3, that function to improve traction between dial 24 and the user's thumb. In some embodiments (not shown), dial 24 may additionally or alternatively comprise one or more projections (e.g., three or four projections spaced around the outer circumference of the dial) that extend outwardly from dial 24 to further assist the user in rotating the dial. Other configurations of dial 24 and push button 26 are also contemplated and encompassed herein.

FIG. 2 illustrates an exploded view of hair styling appliance 10, according to one embodiment. As shown in FIG. 2, multi-function actuator 18 may comprise dial 24, visual indicator ring 25 and push button 26. According to one embodiment, dial 24 may be actuated (e.g., rotated clockwise and counterclockwise) for adjusting a setting of one or more hair appliance variables (e.g., temperature and time). In one embodiment, dial 24 may be rotated clockwise to increase a setting (e.g., a value or set point) of a hair appliance variable, and rotated counterclockwise to decrease the setting of the hair appliance variable. The opposite may be true, in other embodiments. According to another embodiment, dial 24 may be actuated to scroll through and/or select a hair appliance variable from a plurality of hair appliance variables, which are available for user selection and adjustment.

The visual indicator ring 25 may be used to provide a visual indication of one or more hair appliance properties to the user using, for example, light. In one example, the visual indicator ring 25 may blink on/off to provide visual indication that the hair styling appliance 10 is warming up, and may stop blinking once a default or desired temperature setting is reached. When blinking stops (e.g., once the desired temperature setting is reached), the visual indicator ring 25 may turn off or may remain lit. The visual indicator ring 25 may be illuminated with a single color of light, or may be illuminated with different colors of light, to provide visual indication of various hair appliance properties.

In one embodiment, the visual indicator ring 25 may be illuminated with only one color of light. In such an embodiment, the visual indicator ring 25 may blink on/off when a hair appliance setting is being adjusted by a user, or when the hair styling appliance is in the process of adjusting to the new hair appliance setting, and may turn off or remain continuously lit when the hair styling appliance achieves the new hair appliance setting. In another embodiment, the visual indicator ring 25 may be illuminated with a first color of light (e.g., red) when dial 24 is rotated to increase a hair appliance setting (e.g., to a higher temperature), may be illuminated with a second color of light (e.g., blue) when dial 24 is rotated to decrease a hair appliance setting (e.g., to a lower temperature), and may be illuminated with a third color of light (e.g., green) when the hair styling appliance reaches a desired hair appliance setting (e.g., a desired temperature setting). Other ways for providing a visual indication of one or more hair appliance properties to the user, via the visual indicator ring 25, are also contemplated and encompassed herein.

In one embodiment, push button 26 may be actuated for toggling between and/or selecting a hair appliance variable from a plurality of hair appliance variables (e.g., temperature and time), which are available for user selection and adjustment. In another embodiment, push button 26 may be actuated for adjusting a setting of a selected hair appliance variable (e.g., adjusting a temperature setting, or adjusting a fan speed setting). In yet another embodiment, push button 26 may be actuated for activating a timer for performing a styling operation (e.g., curling a section of one's hair). In one example, a default or user-selectable time duration may be associated or set for the timer, and the push button 26 may be actuated for starting a timer count down/up corresponding to the default or user-selected time duration. After receiving user-notification that the time duration has expired, push button 26 may be re-actuated by the user to reactivate the timer for performing a subsequent styling operation. The push button described herein may be implemented with one, a combination or two or more, or all of the functional embodiments mentioned above.

In some embodiments, push button 26 may be formed from an optically opaque material, as shown in the exemplary embodiment of FIGS. 1-2. In other embodiments, push button 26 may be implemented with an optically transparent material, as shown in the exemplary embodiment of FIG. 3. When push button 26 is implemented with an optically transparent material, the multi-function actuator 18 may further comprise a digital display 27, which may be arranged behind push button 26, as shown in FIG. 2. The digital display 27 may be configured for displaying one or more default, selected or current hair appliance settings or values thereof, and/or instructions or symbols intended to instruct the user on how to use the hair styling appliance. The digital display 27 may be illuminated with a single color of light, or may be illuminated with different colors of light. In some embodiments, the digital display 27 may be illuminated with light from one or more LEDs. In some embodiments, the digital display 27 may blink on/off to indicate that a hair appliance variable is being adjusted (e.g., by rotation of dial 24 or actuation of push button 26), and may stop blinking once, or soon after, a desired setting is reached.

It should be understood that the hair styling appliance 10 will inherently include a control circuit for controlling the operation of the appliance. In FIG. 2, a control circuit 34 for controlling the operation of hair styling appliance 10 is depicted as residing within handle 12. As described in more detail below with reference to the method shown in FIG. 6, the control circuit 34 may generally be configured for detecting power received through the electrical supply cord 14 when the on/off button 16 is depressed, and once power is received, for controlling the operation of the hair styling appliance 10 in accordance with one or more default or user-selected hair appliance settings. The control circuit may be implemented using hardware, software or firmware.

In general, control circuit 34 may be configured to control the operation of a hair styling appliance in accordance with one or more hair appliance settings, which may be set and/or adjusted by a user via embodiments of the multi-function actuator described herein. As noted above, the multi-function actuator preferably includes a first actuator and a second actuator, which are arranged adjacent to one another on a hair styling appliance and configured to be actuated independently of one another. Control circuit 34 is coupled to the multi-function actuator and is generally configured for controlling operation of the hair styling appliance in response to actuation of at least one of the first and the second actuators. Example embodiments describing how control circuit 34 may be configured to control the operation of the hair styling appliance in response to such actuation are provided below.

According to a first embodiment, the multi-function actuator described herein may be used to select and/or adjust substantially any number of hair appliance variables, examples of which include, but are not limited to, temperature, time, fan speed, moisture level, ion injection, and barrel rotation speed, as noted above. In such an embodiment, a first actuator of the multi-function actuator may be actuated by a user to select a hair appliance variable, and a second actuator of the multi-function actuator may be actuated by a user to adjust a setting of the selected hair appliance variable. Upon actuation of the first actuator, control circuit 34 may be configured to toggle through and/or select a hair appliance variable from the plurality of hair appliance variables, which are available for user selection and adjustment. Upon actuation of the second actuator, control circuit 34 may be configured to adjust a setting of the selected hair appliance variable, and to subsequently control the operation of the hair styling appliance in accordance with the adjusted setting. In one exemplary implementation of the first embodiment, the first actuator may be push button 26 and the second actuator may be dial 24; however, the opposite may be true in other embodiments.

According to a second embodiment, the multi-function actuator described herein may be used to adjust only two hair appliance variables (e.g., temperature and time, or temperature and fan speed). For example, a first actuator of the multi-function actuator may be actuated by a user to adjust a setting of a first hair appliance variable, and a second actuator of the multi-function actuator may be actuated by a user to adjust a setting of a second (i.e., different) hair appliance variable. In this embodiment, control circuit 34 may be configured to control the operation of the hair styling appliance in accordance with the adjusted settings chosen via user-actuation of the first and/or second actuators, possibly in combination with one or more default settings that are not user-selectable. In one exemplary implementation of the second embodiment, the first actuator may be push button 26 and the second actuator may be dial 24; however, the opposite may be true in other embodiments.

According to a third embodiment, the multi-function actuator described herein may be used to adjust only one hair appliance variable (e.g., time). For example, a first actuator of the multi-function actuator may be actuated by a user to select a time duration, and a second actuator of the multi-function actuator may be actuated by a user to activate a timer configured with the user-selected time duration (or, alternatively, a default time duration). In such an embodiment, control circuit 34 may be configured to adjust a time variable setting to the user-selected time duration in response to user-actuation of the first actuator, and may be configured to activate the timer in response to user-actuation of the second actuator. If the timer is activated, control circuit 34 may be further configured to activate a user notification of time-out (e.g., an audible sound, vibration, light, auto-unroll of hair, etc.) to indicate when the time duration has expired. In one exemplary implementation of the third embodiment, the first actuator may be dial 24 and the second actuator may be push button 26.

According to a fourth embodiment, the timer functionality provided to the push button 26 in the third embodiment may also be provided to the push button 26 in the first and/or second embodiment(s). When incorporated within the first embodiment, for example, push button 26 may be actuated by a user for toggling through and/or selecting a hair appliance variable from a plurality of hair appliance variables, and may be further actuated by a user for activating a timer with a user-selected or default time duration. When incorporated within the second embodiment, push button 26 may be actuated by a user to adjust a time duration, and may be further actuated by a user to activate a timer with the user-selected or default time duration. Push button 26 may be actuated differently to enable the control circuit 34 to distinguish between the dual functionality provided to the push button. In one example, push button 26 may be actuated for a first length of time to select a hair appliance variable (in the first embodiment) or to adjust a time duration (in the second embodiment), and may be actuated for a second length of time to activate the timer (in the first and second embodiments). The second length of time may generally be different (e.g., shorter or longer) than the first length of time.

In addition to various embodiments of hair styling appliances comprising a multi-function actuator, as described above, the present disclosure contemplates and encompasses various user-implemented methods for utilizing a multi-function actuator for adjusting settings of one or more hair appliance variables, and various methods for controlling a hair styling appliance in accordance with one or more adjusted hair appliance settings.

For example, FIGS. 4A-4D illustrate a progression of images depicting an exemplary user-implemented method for utilizing multi-function actuator 18 to adjust a temperature setting for the hair styling appliance 10. FIGS. 5A-5F illustrate a progression of images depicting an exemplary user-implemented method for utilizing multi-function actuator 18 to adjust a time setting and activate a timer for the hair styling appliance. Although depicted in FIGS. 4-5 for selecting and/or using temperature and time settings, multi-function actuator 18 may alternatively be used to select, adjust and/or use other hair appliance variables (e.g., barrel rotation speed, multi-zone temperature settings, moisture level/steam and/or ion injection, etc.) for controlling the depicted hair styling apparatus 10, or may be used to select, adjust and/or use other types of hair appliance variables (e.g., fan speed, temperature, time, moisture level/steam and/or ion injection, etc.) for controlling other types of hair styling apparatuses (e.g., flat irons, hair dryers, etc.). The user-implemented methods shown in FIGS. 4-5 are therefore considered to be exemplary.

As shown in FIGS. 4A-4D, a user may turn on (i.e., apply power to) a hair styling appliance by depressing an on/off switch (e.g., on/off switch 16, FIGS. 1-3) in step 40. Once powered on, the digital display 27 positioned behind push button 26 may be illuminated (e.g., with a green color) to display a temperature setting (e.g., 360° F.) in step 42. The initially displayed temperature may be a default setting (e.g., the lowest available temperature setting) or a previously selected setting (e.g., the last setting selected by a user). In some embodiments, the visual indicator 25 may blink on/off to indicate that the hair styling appliance is warming up, and may stop blinking once the temperature setting is reached. If a user desires a different temperature setting, the dial 24 may be rotated clockwise or counterclockwise to select a new temperature setting in step 44. In some embodiments, the temperature displayed on the digital display 27 may blink on/off in step 46 as the temperature setting is adjusted with the dial 24. When the dial 24 reaches a desired temperature setting, the user may depress the push button 26 to select the desired temperature setting, or may wait for a time-out period (e.g., 2 seconds), after which the current temperature setting is automatically selected. In some embodiments, the temperature displayed on the digital display 27 may stop blinking to indicate that a temperature setting has been selected. In some embodiments, the visual indicator 25 may resume blinking to indicate that the hair styling appliance is heating up/cooling down, and may stop blinking once the styling element 20 of the hair styling appliance 10 reaches the selected temperature setting.

FIGS. 5A-5F illustrate a progression of images depicting an exemplary user-implemented method for utilizing multi-function actuator 18 to adjust a time setting and activate a timer for the hair styling appliance. The progression of images shown in FIGS. 5A-5F assumes that the hair styling appliance has already been turned on by depressing the on/off switch 16.

As shown in FIGS. 5A-5F, the digital display 27 positioned behind push button 26 may initially display a default or previously selected hair appliance variable (e.g., temperature). In step 50, the user may depress and hold push button 26 for a short duration of time (e.g., a minimum of 2 seconds) to select and set another hair appliance variable (selected, e.g., from a plurality of hair appliance variables available for user selection and adjustment). In the illustrated embodiment, the push button 26 is depressed and held to select and set a time setting or duration for applying heat to a section of a user's hair. As is known, varying times for applying heat to the user's hair will provide different styling effects (for example, loose curl or tight curl). The time setting may be adjusted by a user to select a desired time duration or setting with which to apply heat to a section of the user's hair.

Once the push button 26 is released in the illustrated embodiment, the digital display 27 may be illuminated (e.g., with a green color) to display a time setting (e.g., :07) in step 52. The initially displayed time may be a default setting (e.g., the lowest available time duration) or a previously selected setting (e.g., the last time duration selected by a user). In some embodiments, the visual indicator 25 and/or the digital display 27 may blink on/off to remind the user to select a potentially different time setting. If a user desires a different time setting, the dial 24 may be rotated clockwise or counterclockwise to select a new time setting in step 54. In some embodiments, the visual indicator 25 and/or the time displayed on the digital display 27 may continue to blink on/off as the time setting is adjusted with the dial 24. Once a desired time setting is reached, the user may depress the push button 26 to select the desired time setting, or may wait for a time-out period (e.g., 2 seconds), after which the current time setting is automatically selected. In some embodiments, the time displayed on the digital display 27 may stop blinking in step 56 to indicate that a desired time setting has been selected.

When using the hair styling appliance to style a section of the user's hair, the user may depress the push button 26 again in step 58 to start a timer count down/up corresponding to the selected time setting. In one embodiment, the time displayed on the digital display 27 may appear solid and start counting down/up in step 59. When the displayed time reaches an end point (e.g., :00 or the selected time duration), a user notification of time-out (e.g., an audible sound, vibration, light, auto-unroll of hair, etc.) may be activated by the control circuit 34 of the hair styling apparatus to indicate that the selected time duration has been reached. The user notification, thus, indicates that the desired time has elapsed to achieve the desired curl effect (for example tightness of curl). At this point, the user may cease curling the selected portion of hair. If desired, steps 58 and 59 may be repeated, as necessary, to style additional sections of the user's hair.

In the user-implemented methods shown in FIGS. 4-5, the multi-function actuator provides a single, user friendly mechanism with which to control a styling temperature and a styling time for a hair styling operation (such as curling a section of one's hair). In this manner, the multi-function actuator enables a user to easily, quickly and efficiently set multiple hair appliance variables. In addition to temperature and time, other hair appliance variables (such as fan speed, moisture level, ion injection, barrel rotation speed, etc.) may be easily controlled via the multi-function actuator shown in FIGS. 4-5. Further, the multi-function actuator includes a timer mechanism that provides ease of use and enables a user to proceed from section to section of the hair based upon the notification of a time-out. Due to the configuration of the multi-function actuator, the reactivation of the timer for the next section of hair may be performed as the user is styling their hair without having to remove the hair styling appliance from the head region, look at the hair styling appliance or the multi-function actuator, reset the timer, etc.

Figure 6:
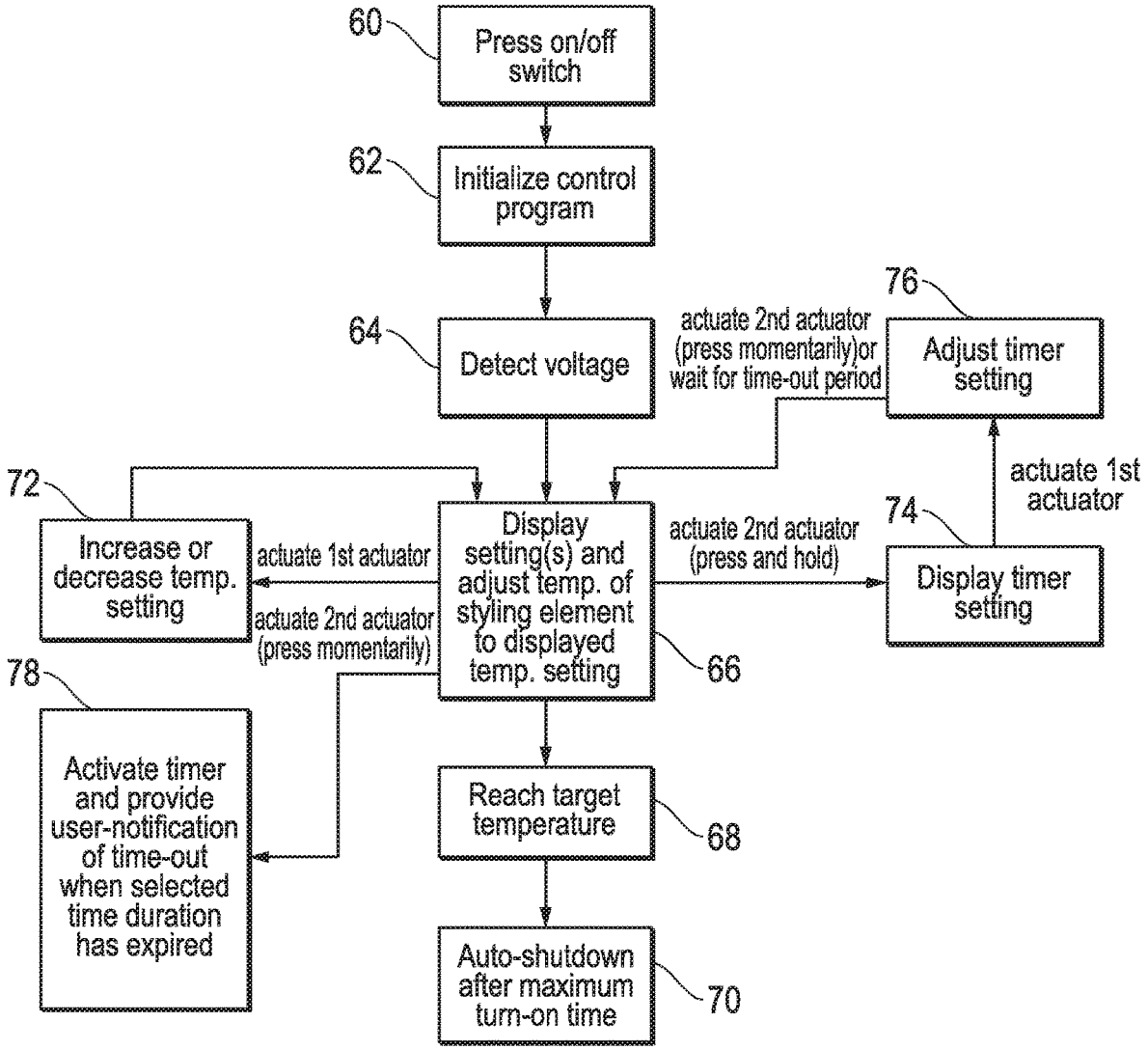
FIG. 6 is a flowchart diagram depicting an exemplary method of controlling a hair styling appliance.

FIG. 6 is a flowchart diagram depicting an exemplary method for controlling a hair styling appliance, according to one embodiment. In general, the method depicted in FIG. 6 may be performed by a control circuit (e.g., control circuit 34), which is configured for controlling the operation of a hair styling appliance including a multi-function actuator, as described herein. Although depicted for controlling temperature and time settings, it will be recognized that the method described herein may alternatively be used for controlling a hair styling appliance in accordance with other hair appliance variables or settings.

As shown in FIG. 6, the method may begin sometime after the hair styling appliance is turned on in step 60, e.g., by depressing the on/off switch. Once the hair styling appliance is turned on, a control program may be initialized in step 62 and a voltage (e.g., 110V or 220V) may be detected in step 64. In step 66, the method may display a temperature setting on the digital display 27 and may adjust a temperature of the styling element of the hair styling appliance to the displayed temperature setting. In some embodiments, the temperature may be increased in step 66 until a target temperature is reached in step 68. In some embodiments, the method may automatically turn off or shut down the hair styling appliance in step 70 after a maximum on-time (e.g., 2 hours) has been reached.

In some cases, a user may actuate a first actuator of the multi-function actuator (e.g., the user may rotate dial 24) to select a new temperature setting. If this occurs, the method may increase or decrease the displayed temperature setting until a desired temperature setting is reached in step 72. Once the desired temperature setting is reached and selected (e.g., by a user depressing push button 26 or waiting for a time-out period), the method may again adjust (e.g., increase/decrease) the temperature of the styling element in step 66 until the new target temperature is reached in step 68.

In some cases, a user may actuate a second actuator of the multi-function actuator (e.g., the user may depress and hold push button 26) for a short duration of time (e.g., a minimum of 2 seconds) to select a new time setting. If this occurs, the method may display a current time setting on the digital display 27 in step 74. If the first actuator (e.g., dial 24) is actuated by the user to select a new time setting, the method may allow the time setting to be adjusted within a range of about 1 second to about 30 seconds in step 76. Once the user re-actuates the second actuator (e.g., momentarily depresses the push button 26 again) to select the new time setting, or waits for a time-out period (e.g., a minimum of 2 seconds), the method may return to step 66.

In some cases, a user may re-actuate the second actuator (e.g., momentarily depress push button 26) again to start a timer count down/up corresponding to the selected time setting in step 78. In one embodiment, the time displayed on the digital display 27 may start counting down/up. When the displayed time reaches an end point (e.g., :00 or the selected time duration), a user notification of time-out (e.g., an audible sound, vibration, light and/or auto-unroll of hair) may be activated by the control circuit to indicate that the selected time duration has been reached. In some cases, a user may want to style another section of hair. If this occurs, the user may re-actuate the second actuator (e.g., momentarily depress push button 26) again to repeat the count-down/up process in step 78. The ergonomic positioning of the multi-function actuator on the hair styling appliance enables the user to easily re-activate the second actuator without requiring the user to look at the second actuator.

In the control method illustrated in FIG. 6, the second actuator (e.g., push button 26) of the multi-function actuator may be actuated by the user to select a different hair appliance variable (e.g., time) for adjustment and/or display, to select a desired setting for a particular hair appliance variable, and to activate a timer. In order to accommodate all such functionality, the second actuator may be actuated for a first length of time (e.g., push button 26 may be pressed and held for a minimum of 2 seconds) when toggling through and selecting a different hair appliance variable for adjustment and/or display, and may be actuated for a second length of time (e.g., push button may be momentarily pressed) when selecting a desired setting or activating the timer. Other lengths of time may be used as long as the first and second lengths of time differ from one another.

The disclosure set forth herein is believed to provide a hair styling appliance having a novel multi-function actuator for adjusting a setting of one or more hair appliance variables. Further modifications and alternative embodiments of the hair styling appliance described herein will be apparent to those skilled in the art in view of this description. It will be recognized, therefore, that the depicted and described hair styling appliance is not limited by these example arrangements. Accordingly, this description is to be construed as illustrative only and is for the purpose of teaching those skilled in the art the manner of carrying out the invention. It is to be understood that the forms of the invention herein shown and described are to be taken as the presently preferred embodiments. Various changes may be made in the implementations and architectures. For example, equivalent elements may be substituted for those illustrated and described herein, and certain features of the invention may be utilized independently of the use of other features, all as would be apparent to one skilled in the art after having the benefit of this description of the invention.

What is claimed:

1. A hair styling appliance, comprising:

a multi-function actuator including a first actuator and a second actuator, which are arranged adjacent to one another on the hair styling appliance and configured to be actuated independently of one another to select and/or adjust a setting of a plurality of hair appliance variables, the hair appliance variables including at least temperature and time, wherein the first actuator is a button and the second actuator is a dial, wherein the dial is shaped and dimensioned to surround at least a portion of an outer circumference of the button; and a control circuit coupled to the multi-function actuator and configured for controlling operation of the hair styling appliance in response to actuation of at least one of the first and the second actuators, wherein upon actuation of the first actuator, the control circuit is configured to toggle through and/or select at least the temperature hair appliance variable or the time hair appliance variable from the plurality of hair appliance variables, which are available for user selection and adjustment; and wherein upon actuation of the second actuator, the control circuit is configured to adjust a setting of a selected hair appliance variable, and to subsequently control the operation of the hair styling appliance in accordance with an adjusted setting.

2. The hair styling appliance as recited in claim 1, wherein the plurality of hair appliance variables further comprise at least one of: fan speed, moisture level, ion injection, and barrel rotation speed.

3. The hair styling appliance as recited in claim 1, wherein:

upon actuation of the first actuator for a first length of time, the control circuit is configured to toggle through and/or select a hair appliance variable from the plurality of hair appliance variables; and upon actuation of the first actuator for a second length of time, the control circuit is configured to activate a timer, whereupon reaching an end point of the timer, the control circuit is further configured to activate a user notification of time-out to indicate that a selected time duration has been reached.

4. The hair styling appliance as recited in claim 3, wherein the first length of time is longer than the second length of time, or vice versa.

5. The hair styling appliance as recited in claim 3, wherein the selected time duration is:

a default time duration used by the control circuit; or a user-selectable time duration chosen by a user through actuation of the first actuator for the first length of time to select a time variable from the plurality of hair appliance variables, and through actuation of the second actuator to adjust a setting of the time variable to the selected time duration.

6. The hair styling appliance as recited in claim 1, wherein the control circuit is configured to:

adjust a setting of a first hair appliance variable in response to user-actuation of the first actuator;

adjust a setting of a second hair appliance variable in response to user-actuation of the second actuator; and control the operation of the hair styling appliance in accordance with the adjusted settings.

7. The hair styling appliance as recited in claim 6, wherein the first actuator is a button and the second actuator is a dial.

8. The hair styling appliance as recited in claim 6, wherein the first hair appliance variable and the second hair appliance variable each comprise a different one of the following variables: temperature, time, fan speed, moisture level, ion injection, and barrel rotation speed.

9. The hair styling appliance as recited in claim 6, wherein the first hair appliance variable is a time variable, and wherein the control circuit is configured to:

adjust the time variable to a user-selected time duration in response to user-actuation of the first actuator for a first length of time;

activate a timer in response to user-actuation of the first actuator for a second length of time, wherein if the timer is activated, the control circuit is further configured to activate a user notification of time-out to indicate when the user-selected time duration has been reached.

10. The hair styling appliance as recited in claim 9, wherein the first length of time is shorter than the second length of time, or vice versa.

11. The hair styling appliance as recited in claim 1, wherein the control circuit is configured to:

adjust a setting of a time variable to a user-selected time duration in response to user-actuation of the first actuator; and activate a timer in response to user-actuation of the second actuator, wherein if the timer is activated, the control circuit is further configured to activate a user notification of time-out to indicate when the user-selected time duration has been reached.

12. The hair styling appliance as recited in claim 11, wherein the first actuator is a dial and the second actuator is a button.

13. A hair styling appliance, comprising:

a multi-function actuator including a first actuator and a second actuator, which are arranged adjacent to one another on the hair styling appliance and configured to be actuated independently of one another, wherein one of the first and second actuators is shaped and dimensioned to surround at least a portion of an outer circumference of the other of the first and second actuators; and a handle that enables a user to grip a lower portion of the handle with the user's palm and fingers without actuating the multi-function actuator with the user's palm or fingers;

wherein the multi-function actuator is positioned near an upper portion of the handle at a location, which enables the user to manipulate the multi-function actuator with the user's thumb, and wherein the hair styling appliance further comprises an elongated barrel extending out from an upper portion of the handle, and wherein the multi-function actuator is positioned near a juncture between the elongated barrel and the upper portion of the handle.

14. The hair styling appliance as recited in claim 13, wherein the multi-function actuator is the only actuator included on the hair styling appliance.

15. The hair styling appliance as recited in claim 13, further comprising a power button for turning the hair styling appliance on/off, wherein no actuators other than the multi-function actuator and the power button are included on the hair styling appliance.

16. The hair styling appliance as recited in claim 13, wherein the hair styling appliance is a curling iron.

17. The hair styling appliance as recited in claim 16, wherein the upper portion of the handle is bent at an angle of approximately 90° to the lower portion of the handle, wherein the elongated barrel extends out from the upper portion along a longitudinal axis of the upper portion, and wherein the multi-function actuator is positioned at or near an outside corner formed between the upper portion and lower portion of the handle.

18. The hair styling appliance as recited in claim 13, wherein the first actuator is configured to be actuated by a user for selecting a hair appliance variable from a plurality of hair appliance variables, which are available for user selection and adjustment, and wherein the second actuator is configured to be actuated by a user for adjusting a setting of the selected hair appliance variable.

19. The hair styling appliance as recited in claim 18, wherein the plurality of hair appliance variables comprise two or more of the following: temperature, time, fan speed, moisture level, ion injection, and barrel rotation speed.

20. The hair styling appliance as recited in claim 13, wherein the first actuator is configured to be actuated by a user for activating a timer for performing a styling operation.

21. The hair styling appliance as recited in claim 20, wherein prior to activating the timer, the second actuator is configured to be actuated by a user for setting a time duration for the timer.

22. The hair styling appliance as recited in claim 21, wherein subsequent to activating the timer, and subsequent to receiving user-notification that the time duration for the timer has expired, the first actuator is configured to be re-actuated by the user to reactivate the timer for performing a subsequent styling operation.

23. The hair styling appliance as recited in claim 22, wherein the multi-function actuator is ergonomically positioned near the upper portion of the handle at a location, which enables the user to activate and reactivate the first actuator with the user's thumb without the user having to look at the first actuator.

* * * * *